US005533915A

United States Patent [19]

Deans

[11] Patent Number: 5,533,915

[45] Date of Patent: Jul. 9, 1996

[54] ELECTRICAL CONNECTOR ASSEMBLY

[76] Inventor: William S. Deans, 7628 Jackson St., Paramount, Calif. 90723

[21] Appl. No.: 125,308

[22] Filed: Sep. 23, 1993

[51] Int. Cl.[6] ..... H01R 13/17

[52] U.S. Cl. ..... 439/678; 439/819; 439/825

[58] Field of Search ..... 439/692, 678, 439/819, 825, 827, 887

[56] References Cited

U.S. PATENT DOCUMENTS

| | | | |
|---|---|---|---|
| 2,121,338 | 6/1938 | Chirelstein | 439/692 |
| 2,203,122 | 6/1940 | Anderson | 439/692 X |
| 3,233,211 | 2/1966 | Smith | 439/887 X |
| 4,018,497 | 4/1977 | Bulanchuk | 439/819 X |
| 4,342,498 | 8/1982 | Patton et al. | 439/887 X |

FOREIGN PATENT DOCUMENTS

| | | | |
|---|---|---|---|
| 0318831 | 6/1989 | European Pat. Off. | 439/887 |
| 1036107 | 9/1953 | France | 439/692 |
| 704450 | 3/1941 | Germany | 439/825 |

OTHER PUBLICATIONS

Available ASA Receptacle Design and Their Application, by P. J. Schram in Electrical Construction and Maintenance, pp. 102–103, Publ. Jun., 1964.

*Primary Examiner*—Z. R. Bilinsky
*Attorney, Agent, or Firm*—Edgar W. Averill, Jr.

[57] ABSTRACT

An electrical collector assembly with a male connector and a female connector. The assembly is capable of carrying a large amount of current between the male and female connectors. The female connector body has a rectangular opening which supports a flat elongated connector pin with a space above the pin. The male connector body supports a male connector pin which extends from the body, a thin beryllium leaf spring is supported against one side of the portion of the male connector pin which extends from the male connector body. When the male connector pin is plugged into the female connector body, the leaf spring urges the male connector pin against the female connector pin.

10 Claims, 3 Drawing Sheets

ELECTRICAL CONNECTOR ASSEMBLY

BACKGROUND OF THE INVENTION

The field of the invention is electrical connectors and the invention relates more particularly to electrical connectors capable of carrying a relatively large amount of current.

With the improvement in battery design, many portable devices require that a relatively large amount of current be carried when operating the device. It is also common that this current must be carried through a connector so that a recharged battery can be easily plugged into the device or other controls may be easily connected or disconnected.

Because of the large amount of current flowing in such devices, many connectors tended to gall at the interface between the male and female connectors which in turn would cause a resistance which would lead to a heating and often destruction of the connector. Such connectors also degraded the performance of the battery powered device.

Another problem with connectors capable of carrying relatively large amount of current is that such connectors are very difficult to plug in and unplug. It is also important that such connectors be light in weight since it is usually desired that the electrically power devices be as light as possible.

BRIEF SUMMARY OF THE INVENTION

It is an object of the present invention to provide an electrical connector assembly with a male and female connector which assembly is capable of carrying a large amount of current without galling and yet which is easy to plug and unplug.

The present invention is for an electrical connector assembly including a male connector and a female connector. The female connector has a female connector body with a face, and the body has a generally rectangular opening. A female connector pin is held in the female connector body recessed from the face and positioned so that there is a space between the top of the connector pin and the top of the rectangular opening for positioning a male connector pin therein. A male connector body also has a rectangular opening which holds a male connector pin which extends past the face of the male connector body. A thin leaf spring with a curved portion overlies the extended length of the male connector pin. When the male connector pin is plugged into the opening above the female connector pin, the thin leaf spring abuts the top of the rectangular opening in the female connector urging the male connector pin against the female connector pin to provide an excellent electrical contact. Preferably one of the pins is plated with nickel and gold and the other pin is plated with nickel and silver. Also, preferably there is a pair of male connector pins and a pair of female connector pins which are positioned at an angle from one another so that the connector is polarized and can only be plugged in one way.

DESCRIPTION OF THE PREFERRED EMBODIMENTS

Figure 1:
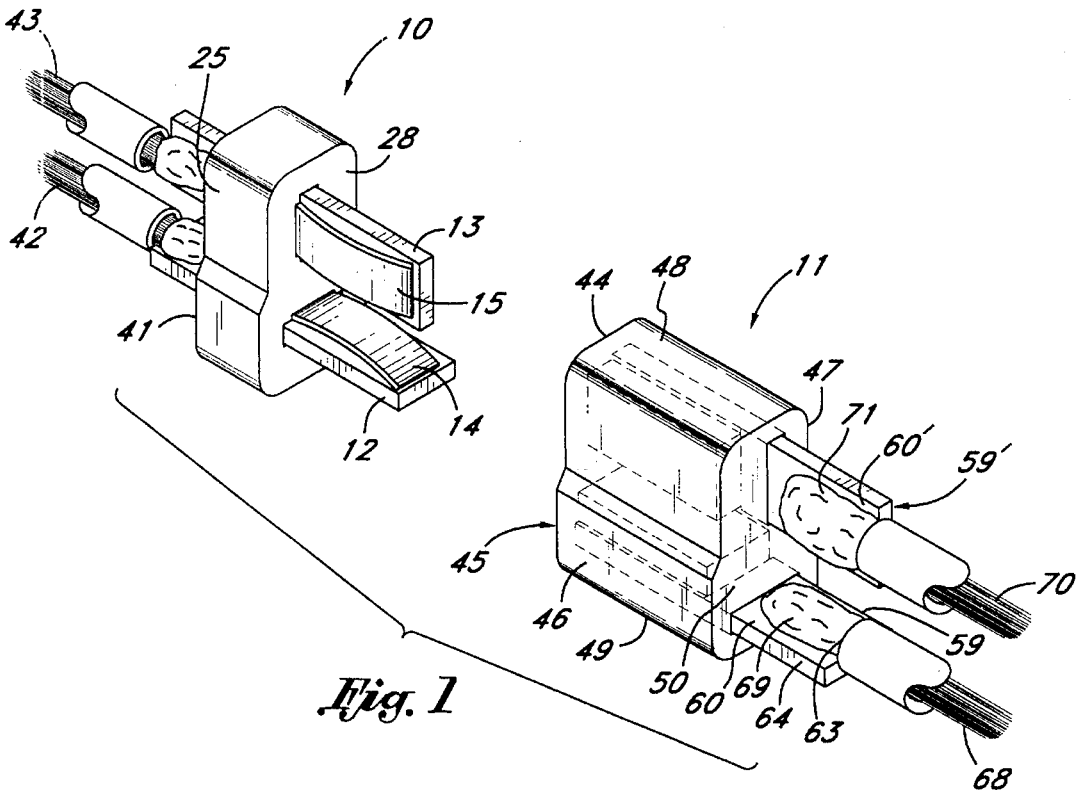
FIG. 1 is a perspective view showing the male and female connectors of the present invention in an unplugged configuration.

The electrical connector assembly of the present invention is shown in perspective view in an unplugged configuration in FIG. 1 where the male connector assembly is indicated by reference character 10 and the female connector assembly by reference character 11. Male connector assembly 10 has an upper male connector pin 12 and a lower male connector pin 13, connector pins 12 and 13 are identical in shape and thus, only one will be described herein. A beryllium copper leaf spring 14 and an identical beryllium copper leaf 15 are held adjacent one side of connector pins 12 and 13 respectively.

Figure 2:
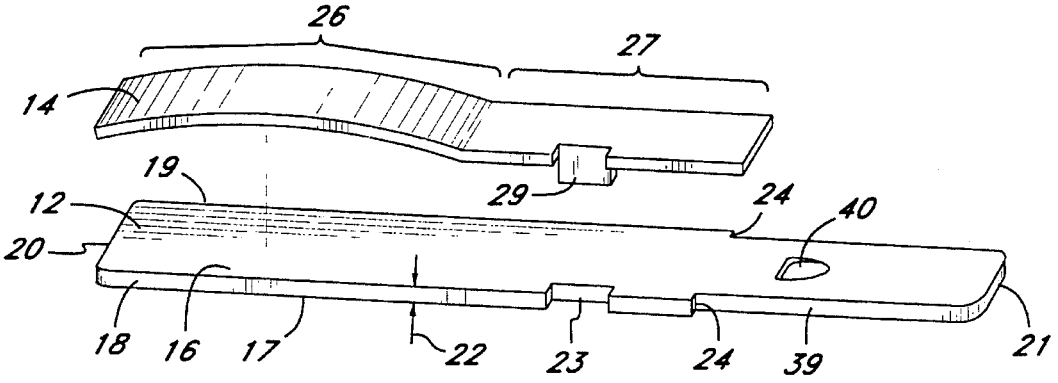
FIG. 2 is an exploded perspective view of a male connector pin and leaf spring of the male connector of FIG. 1.

Turning to FIG. 2, male connector pin 12 has a top 16, a bottom 17, a first side 18, a second side 19, a forward end 20, and a rearward end 21. Connector pin 12 is fabricated from copper which has preferably been nickel plated followed by gold plating. Male connector pin 12 has a thickness 22 and a notch 23 is formed along the first side thereof. Pin 12 also has a step 24 which helps position the pin in the generally rectangular opening formed in the male connector body 25.

Leaf spring 14 is fabricated from beryllium copper and has a curved length 26 and a flat length 27. The curved length 26 extends past the face 28 of connector body 24 and the flat portion 27 is held within connector body 24. A tab 29 fits into notch 23 to hold the spring in place both during assembly and later on during use. Leaf spring 15 is of identical construction and also has a tab which fits into a corresponding notch in connector pin 13.

Figure 9:
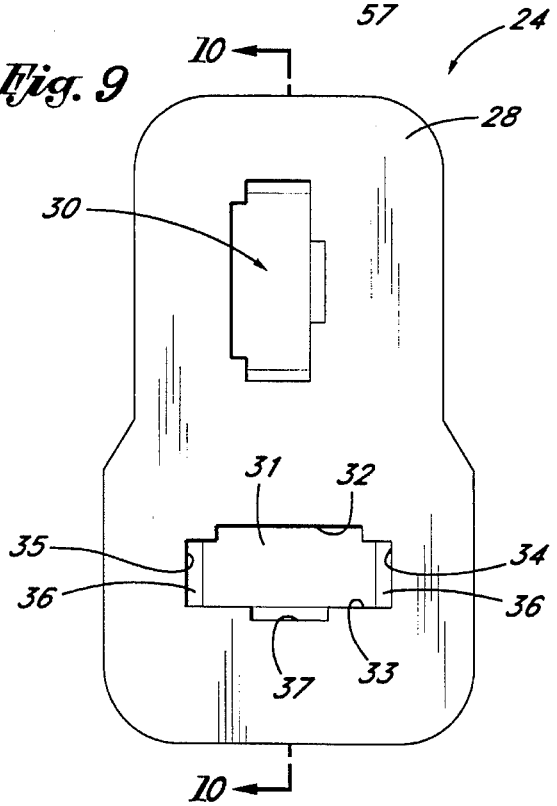
FIG. 9 is a front view showing the face of the male connector body of FIG. 1.
Figure 10:
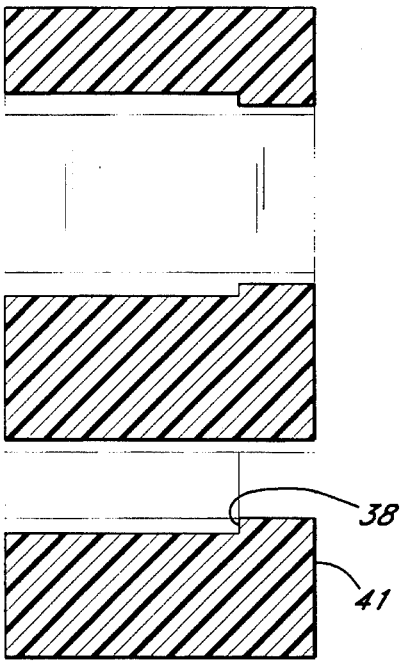
FIG. 10 is a cross-sectional view taken along line 10—10 of FIG. 9.

The details of the male connector body 24 are shown best in FIGS. 9 and 10. In FIG. 9, the body is viewed from the face 28 and can be seen to have a generally rectangular upper opening 30 and an identically shaped (although rotated 90°) generally rectangular lower opening 31. Opening 31 has a top 32, a bottom 33, a first side 34 and a second side 35. The first and second sides also have steps 36 which mate with steps 24 on connector pin 12 as shown in FIG. 2 to provide a stop against further rearward movement of the connector pin. A bottom groove 37 is formed in bottom 33 and ends at a step 38 shown in FIG. 10. This step cooperates with a protrusion 39 which is formed by making an indentation 40 in the top 16 of connector pin 12.

The beryllium copper leaf spring 14 is placed over male connector pin 12 so the tab 29 fits in notch 30. The rearward end 21 of connector pin 12 is inserted in opening 31 and the protrusion 39 fits within bottom groove 37. Leaf spring 14 fits within opening 31. As pin 12 is forced into male connector body 25, the protrusion 39 displaces a portion of step 38 until it reaches the back 41 at which point it snaps against back 41 preventing the pin from being pulled out. A second connector pin 13 and beryllium copper leaf spring 15 is inserted in upper generally rectangular opening 30 in an identical manner. Male conductors 42 and 43 are soldered near the rearward end 21 of each of the connector pins in a manner analogous to that shown on the female connector assembly 11 of FIG. 1.

Figure 7:
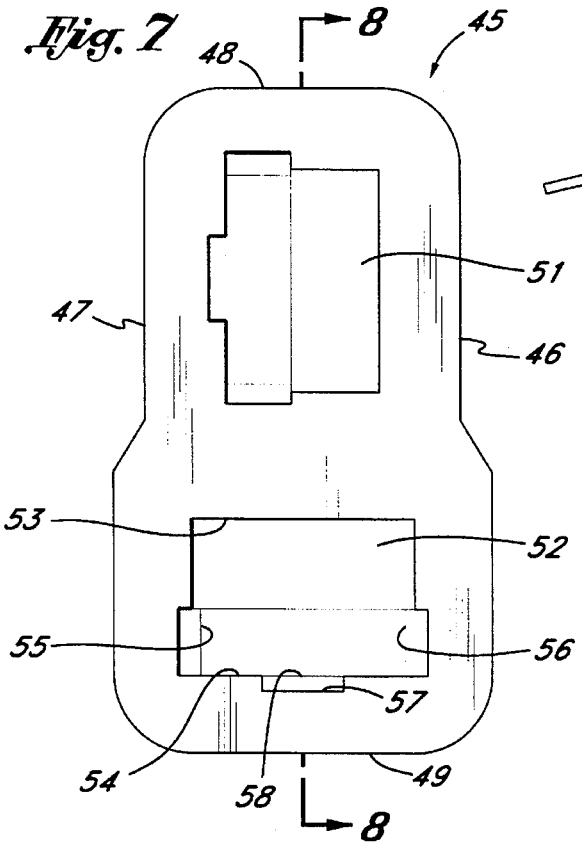
FIG. 7 is a front view showing the face of the female connector body of the connector assembly of FIG. 1.
Figure 6:
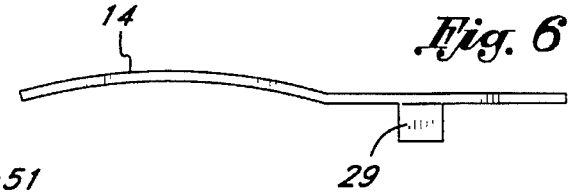
FIG. 6 is a side view thereof.
Figure 8:
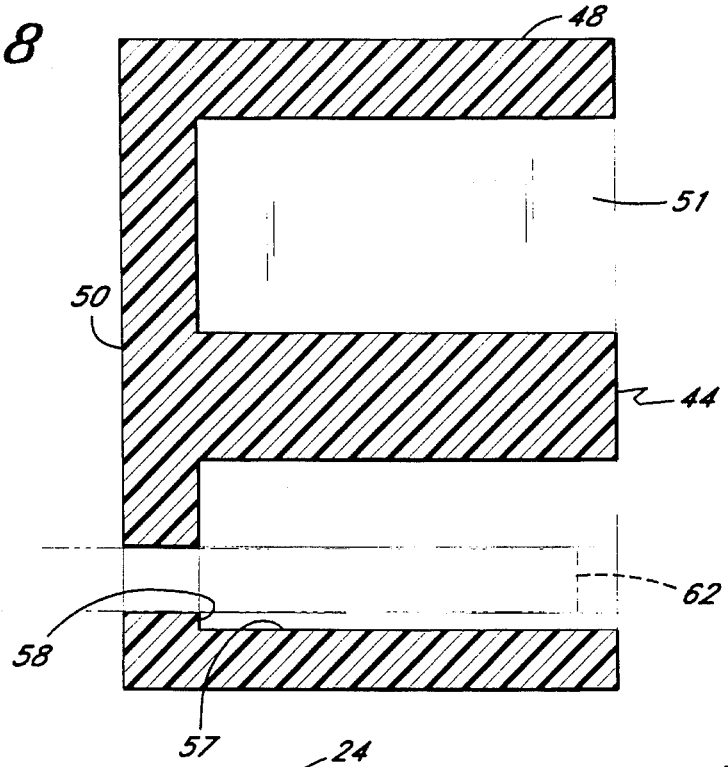
FIG. 8 is a cross-sectional view taken along line 8—8 of FIG. 7.

The construction of female connector assembly 11 is shown best in FIGS. 7 and 8 which are taken from the face 44 of female connector body 45. Female connector body 45 has a first side 46, a second side 47, a top 48, a bottom 49 and a back 50. As shown in FIG. 7, connector body 45 has a generally rectangular upper opening 51 and a lower generally rectangular opening 52 identical to 51 except that it is rotated 270° as viewed in FIG. 7. Generally rectangular opening 52 has a top 53, a bottom 54, a first side 55, and a second side 56. A bottom groove 57 has a stop 58 which serves an analogous function to stop 38 of FIG. 10, i.e., the female connector pins 59 and 60 each have protrusions analogous to protrusion 39 on male connector pin 12.

Figure 3:
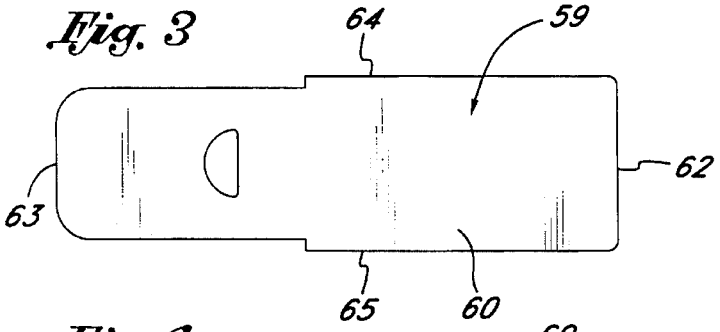
FIG. 3 is a plan view of the female connector pin of the connector assembly of FIG. 1.
Figure 4:
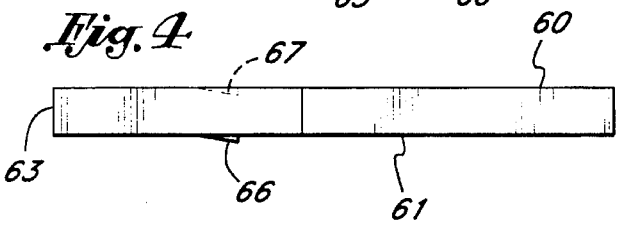
FIG. 4 is a side view thereof.
Figure 5:
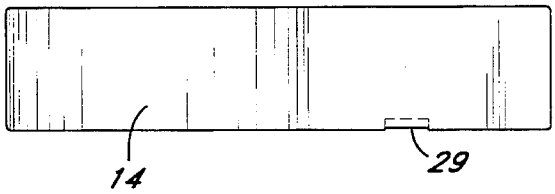
FIG. 5 is a plan view of the leaf spring of the male connector pin of FIG. 1.

The detail of construction of the female connector pin is shown best in FIGS. 3 and 4 where female connector pin 59 can be seen to have a top 60, a bottom 61, a forward end 62, a rearward end 63, a first side 64, and a second side 65. A protrusion 66, and a matching indentation 67, are also shown in FIG. 4 and hold the connector pin 59 in the connector body 45. Connector pin 59 is shown in phantom view in FIG. 8 where it can be seen that the forward end 62 is recessed from the face 44. This helps to avoid any undesired contact of male connector pins 12 and 13 unless they are oriented properly so that they will pass beneath the face 44 of connector body 45. The detail of construction of the beryllium copper spring connectors is shown best in FIG. 5 where it can be seen that tab 29 extends substantially below spring 14. It can also be seen that the corners of the spring are slightly rounded.

It can also be fairly seen in FIG. 1 that conductor 68 is soldered at 69 to the portion of female connector pin 59 which extends past back 50 of conductor body 45. Similarly, conductor 70 is soldered at 71 to connector pin 59'.

In operation connector pins 12 and 13 are inserted into generally rectangular openings 51 and 52. The beryllium copper leaf spring 14 contacts the top 53 of rectangular opening 52, thereby forcing the beryllium 17 of connector pin 12 against the top 60 of connector pin 59. This provides an exceptionally effective contact area and yet the male and female connectors do not require excessive force to be plugged together or to be unplugged. The connector bodies are preferably fabricated from a strong dielectric materials such as glass fiber reinforced nylon. This provides a smooth contact surface with the beryllium copper leaf springs. When using a gold plated male connector and a silver plated female connector, it has been found that the resulting connection is capable of passing 30 amps from an 8 volt battery without any breakdown at the connection.

While gold and silver are the preferred contact materials, it is also possible that both conductors can be gold plated, although gold and silver are still preferred. The connectors are very light in weight, easy to grasp, to plug and unplug, and easy to solder a conductor thereto.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An electrical connector assembly including a male connector and a female connector, said assembly being capable of carrying a large amount of current between the male and female connectors, said connector comprising:

a female connector body having a connector face, a top, a bottom, a first side, a second side and a back, said female connector body having a first generally rectangular opening extending inwardly from the connector face, said generally rectangular opening having a bottom, a first side, a second side, and a top, said generally rectangular opening extending to the back of the connector body and having a height between the top and bottom of the opening;

a female connector pin held in the female connector body, said female connector pin being an elongated, generally rectangular, bar having a top, a bottom, a first side, a second side, a forward end, a rearward end, and a thickness, said bar being supported in the generally rectangular opening so that the forward end is recessed from the face of the female connector body and the rearward end extends past the back of the connector body, and the thickness of the connector pin is substantially less than the height of the generally rectangular opening so that there is a connector opening above the top of the connector pin beneath the top of the generally rectangular opening;

a male connector body having a connector face, a top, a bottom, a first side, a second side and a back, said male connector body having a first generally rectangular opening extending inwardly from the connector face, said generally rectangular opening having a bottom, a first side, a second side, and a top, said generally rectangular opening extending to the back of the male connector body and having a height between the top and bottom of the opening to provide a male connector pin opening;

a male connector pin held in the male connector body, said male connector pin being an elongated, generally rectangular, bar having a top, a bottom, a first side, a second side, a forward end, a rearward end, and a thickness, said bar being supported in the generally rectangular opening so that the forward end extends outwardly from the face of the male connector body to provide an extended length and the rearward end extends past the back of the connector body, and a central portion within said male connector body, and the thickness of the connector pin is slightly less than the height of the generally rectangular opening so that there is room for a leaf spring above the top of the connector pin along its central portion beneath the top of the generally rectangular opening; and a generally rectangular, thin leaf spring having a curved portion overlying the extended length of the male connector pin and a straight portion overlying the central portion of said male connector pin and said thin leaf spring being positioned so that when the male connector pin is inserted in the female connector opening, the spring connector abuts and is deflected by the top of the generally rectangular opening of the female connector body whereby the bottom of the male connector pin is pressed against the top of the female connector pin when the male connector pin is inserted into the female connector opening to provide an excellent electrical path between the male and female connector pins.

2. The electrical connector assembly of claim 1 wherein one of the male or female conductor pins is copper plated with nickel and gold.

3. The electrical connector assembly of claim 1 wherein one of the male or female conductor pins is copper plated with nickel and silver.

4. The electrical connector assembly of claim 3 wherein the other of the female or male conductor pins is copper plated with nickel and gold.

5. The electrical connector assembly of claim 1 wherein the male and female connector bodies each have two generally rectangular openings and two connector pins.

6. The electrical connector assembly of claim 4 wherein the male connector pin is gold plated and the female connector pin is silver plated.

7. An electrical connector assembly including a male connector and a female connector, said assembly being capable of carrying a large amount of current between the male and female connectors, said connector comprising:

a female connector body having a connector face, a top, a bottom, a first side, a second side and a back, said female connector body having a first generally rectangular opening extending inwardly from the connector face, said generally rectangular opening having a bottom, a first side, a second side, and a top, said generally rectangular opening extending to the back of the connector body and having a height between the top and bottom of the opening;

a female connector pin held in the female connector body, said female connector pin being an elongated, generally rectangular, bar having a top, a bottom, a first side, a second side, a forward end, a rearward end, and a thickness, said bar being supported in the generally rectangular opening so that the forward end is recessed from the face of the female connector body and the rearward end extends past the back of the connector body, and the thickness of the connector pin is substantially less than the height of the generally rectangular opening so that there is a connector opening above the top of the connector pin beneath the top of the generally rectangular opening;

a male connector body having a connector face, a top, a bottom, a first side, a second side and a back, said male connector body having a first generally rectangular opening extending inwardly from the connector face, said generally rectangular opening having a bottom, a first side, a second side, and a top, said generally rectangular opening extending to the back of the male connector body and having a height between the top and bottom of the opening to provide a male connector pin opening;

a male connector pin held in the male connector body, said male connector pin being an elongated, generally rectangular, bar having a top, a bottom, a first side, a second side, a forward end, a rearward end, and a thickness, said bar being supported in the generally rectangular opening so that it has a covered length, and the forward end extends outwardly from the face of the male connector body to provide an extended length and the rearward end extends past the back of the connector body, and a notch is formed in the side of the connector pin in the covered length and the thickness of the connector pin is slightly less than the height of the generally rectangular opening so that there is room for a leaf spring above the covered length of the connector pin beneath the top of the generally rectangular opening; and a generally rectangular, thin leaf spring having a curved portion overlying the extended length of the male connector pin and at least a portion of the covered length and the thin leaf spring has a covered length including a downwardly extending tab fitted into the notch in the male connector, said male connector pin and said thin leaf spring being positioned so that when the male connector pin is inserted in the female connector opening, the leaf spring abuts and is deflected by the top of the generally rectangular opening of the female connector body whereby the bottom of the male connector pin is pressed against the top of the female connector pin when the male connector pin is inserted into the female connector opening to provide an excellent electrical path between the male and female connector pins.

8. The electrical connector assembly of claim 7 wherein the thin leaf spring is fabricated from beryllium copper.

9. The electrical connector assembly of claim 8 wherein there are two male and two female connector pins.

10. The electrical connector assembly of claim 9 wherein the male and female connector pins are oriented at 90° with respect to each other so that the male and female connector assemblies may only be connected in one way.

* * * * *

UNITED STATES PATENT AND TRADEMARK OFFICE
Certificate

Patent No. 5,533,915 Patented: July 9, 1996

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: William S. Deans, Paramount, CA (US); and Robin W. Deans, Long Beach, CA (US).

Signed and Sealed this Seventeenth Day of April 2007.

PAULA A. BRADLEY
*Supervisory Patent Examiner*
Art Unit 2833